US011824300B2

(12) United States Patent
Kim et al.

(10) Patent No.: US 11,824,300 B2
(45) Date of Patent: Nov. 21, 2023

(54) CONNECTOR ASSEMBLY INCLUDING TERMINAL PROTECTION FEATURES

(71) Applicant: Tyco Electronics AMP Korea Co., Ltd., Kyongsangbuk-Do (KR)

(72) Inventors: Yo-Han Kim, Gyeongsan-Si (KR); Chul Hwan Cho, Gyeongsan-Si (KR); Sung Jun Choi, Gyeongsan-Si (KR)

(73) Assignee: Tyco Electronics AMP Korea Co., Ltd., Kyongsangbuk-Do (KR)

( * ) Notice: Subject to any disclaimer, the term of this patent is extended or adjusted under 35 U.S.C. 154(b) by 28 days.

(21) Appl. No.: 17/495,026

(22) Filed: Oct. 6, 2021

(65) Prior Publication Data

US 2022/0109264 A1 Apr. 7, 2022

(30) Foreign Application Priority Data

Oct. 6, 2020 (KR) ..... 10-2020-0128788
Sep. 1, 2021 (KR) ..... 10-2021-0116215

(51) Int. Cl.
*H01R 13/506* (2006.01)
*H01R 13/627* (2006.01)
*H01R 13/629* (2006.01)

(52) U.S. Cl.
CPC ..... *H01R 13/506* (2013.01); *H01R 13/629* (2013.01); *H01R 13/6273* (2013.01)

(58) Field of Classification Search
CPC ..... H01R 13/4538; H01R 13/506; H01R 13/629; H01R 13/6273
See application file for complete search history.

(56) References Cited

U.S. PATENT DOCUMENTS 6,666,698 B2 * 12/2003 Beck, Jr. ..... H01R 13/641 439/157
6,821,135 B1 * 11/2004 Martin ..... H01R 13/629 439/378
2017/0117660 A1 4/2017 Furuya et al.
2019/0288439 A1 * 9/2019 Bae ..... H01R 13/4538
2021/0203101 A1 * 7/2021 Yasuda ..... H01R 13/4538

FOREIGN PATENT DOCUMENTS

EP 3544125 A2 9/2019
KR 20180010934 A * 1/2018
KR 20180010934 A1 1/2018

OTHER PUBLICATIONS

Extended European Search Report, Application No. 21200627.4-1201, dated Feb. 24, 2022, 9 pages.

* cited by examiner

*Primary Examiner* — Oscar C Jimenez
(74) *Attorney, Agent, or Firm* — Barley Snyder

(57) ABSTRACT

A connector assembly includes a housing having a housing base, a housing body protruding from the housing base, and a first housing protrusion provided inside the housing body. A protection part includes a protection base facing the housing base, a protection body protruding from the protection base, and a first protection arm extending from the protection body for engaging with the first housing protrusion. An insertion part of the assembly includes an insertion body for inserting inside of the protection part, and a first insertion protrusion protruding from the insertion body to interfere with the first protection arm. The first insertion protrusion deforms the first protection arm and causes the first protection arm to disengage from the first housing protrusion while the insertion body is inserted inside of the protection part.

19 Claims, 13 Drawing Sheets

CONNECTOR ASSEMBLY INCLUDING TERMINAL PROTECTION FEATURES

CROSS-REFERENCE TO RELATED APPLICATIONS

This application claims the benefit of Korean Patent Application No. 10-2020-0128788 filed on Oct. 6, 2020, and Korean Patent Application No. 10-2021-0116215 filed on Sep. 1, 2021, in the Korean Intellectual Property Office, the entire disclosures of which are incorporated herein by reference for all purposes.

FIELD OF THE INVENTION

The present invention relates to electrical connectors, and more particularly, to an electrical connector having a protection part.

BACKGROUND

A connector is a type of electric component that allows or blocks an electrical connection. Connectors are used in various electromechanical devices such as automobiles or home appliances to enable an electrical and/or physical connection between a plurality of electronic components. Often, conductive connection terminals of a connector are subject to damage as the connector is mated and unmated with a corresponding complementary connector. As a result, connectors may incorporate protective features aimed at preventing damage to the terminals of the connector. This may be achieved by providing additional support to the connection terminals during mating and/or unmating operations. However, these solutions can lead to an undesired increase in the overall size of the connector.

Accordingly, improved protective systems for preventing damage to connection terminals of a connector by maintaining or supporting the connection terminals are desired which do not necessitate a significant increase in an overall size of the connector.

SUMMARY

According to an embodiment of the present disclosure, a connector assembly includes a housing having a housing base, a housing body protruding from the housing base, and a first housing protrusion provided inside the housing body. A protection part includes a protection base facing the housing base, a protection body protruding from the protection base, and a first protection arm extending from the protection body for engaging with the first housing protrusion. An insertion part of the assembly includes an insertion body for inserting inside of the protection part, and a first insertion protrusion protruding from the insertion body to interfere with the first protection arm. The first insertion protrusion deforms the first protection arm and causes the first protection arm to disengage from the first housing protrusion while the insertion body is inserted inside of the protection part.

BRIEF DESCRIPTION OF THE DRAWINGS

The invention will now be described by way of example with reference to the accompanying Figures, of which.

DETAILED DESCRIPTION OF THE EMBODIMENTS

Figure 1:
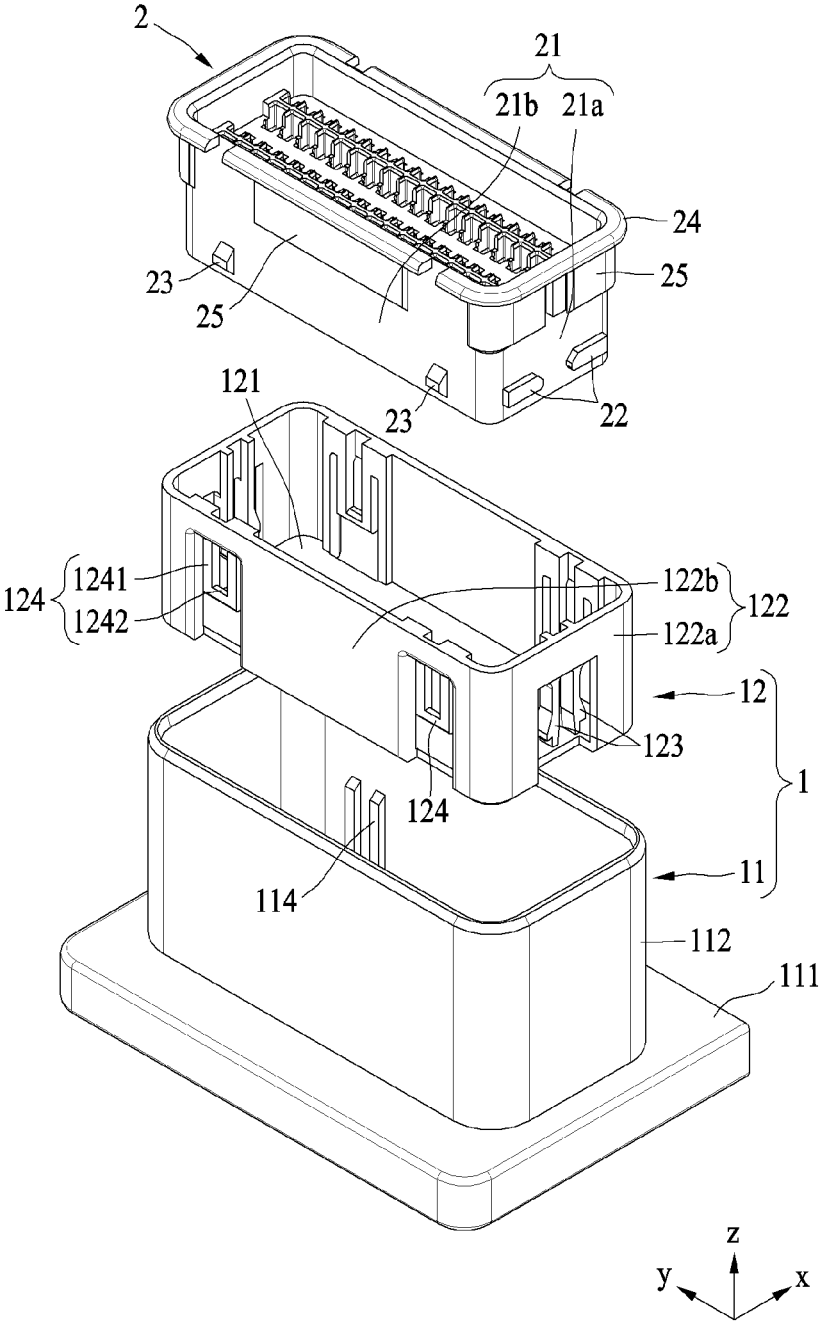
FIG. 1 is an exploded perspective view illustrating a connector assembly according to an example embodiment.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
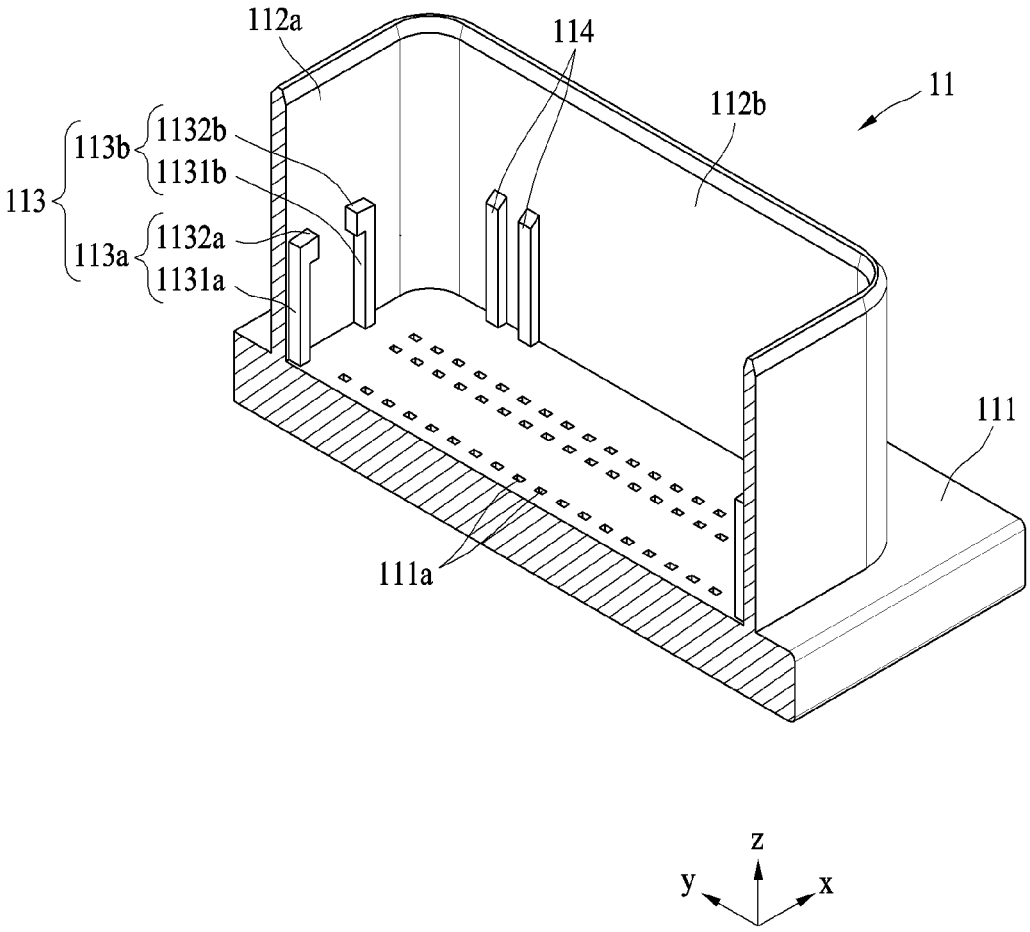
FIG. 2 is a cross-sectional view illustrating a housing according to an example embodiment.
Figure 3:
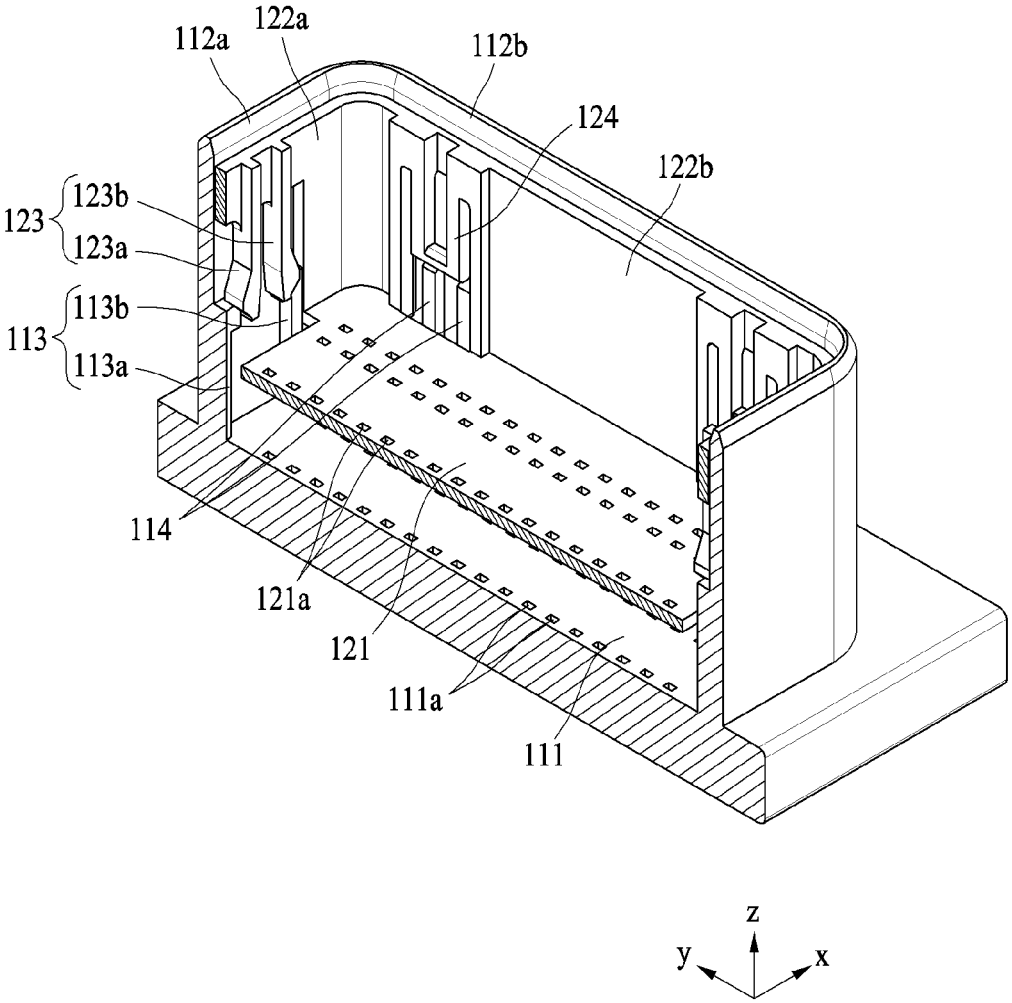
FIG. 3 is a cross-sectional view illustrating a housing and a protection part according to an example embodiment.

FIG. 1 is an exploded perspective view illustrating a connector assembly according to an example embodiment, FIG. 2 is a cross-sectional view illustrating a housing according to an example embodiment, and FIG. 3 is a cross-sectional view illustrating the housing and a protection part according to an example embodiment. Referring to FIGS. 1 to 3, a connector assembly may include a first connector 1 and a second connector 2 that may be coupled to or decoupled from each other. Any one connector of the first connector 1 and the second connector 2 may be inserted toward the other connector by an external force. Any one connector of the first connector 1 and the second connector 2 may be referred to as a female connector, and the other connector may be referred to as a male connector.

The first connector 1 may include a housing 11 and a protection part 12. The protection part 12 may be provided in an inside of the housing 11, as shown in FIG. 3. For ease of description, FIG. 1 shows the protection part 12 being decoupled from the inside of the housing 11. A stopper may be provided at an upper end portion of the housing 11 to prevent unintentional separation of the protection part 12 therefrom. For example, the stopper may protrude inwardly from an inner side surface of the housing 11 to engage with the upper end portion of the protection part 12.

A center portion of the housing 11 and a center portion of the protection part 12 may be spaced apart from each other in the z-axial direction. Through this structure, the protection part 12 may improve (e.g., correct and/or maintain) the arrangement of a plurality of terminals (not shown) mounted on or in the first connector 1. Specifically, a first portion of each of the plurality of terminals (not shown) may be supported by the housing 11, and a second portion thereof spaced apart from the first portion in the z-axial direction may be supported by the protection part 12.

At respective edge portions of the housing 11 and the protection part 12, components that interfere with each other may be provided. Specifically, the housing 11 may include first housing protrusions 113 and second housing protrusions 114 that interfere with the protection part 12. The protection part 12 may include first protection arms 123 that interfere with the first housing protrusions 113 and second protection arms 124 that interfere with the second housing protrusions 114. The first housing protrusions 113 and the second housing protrusions 114 may remain in a fixed state while the interference state (i.e., engaged or disengaged) with the first protection arms 123 and the second protection arms 124 is switched or changed. Meanwhile, the first protection arms 123 and the second protection arms 124 may be elastically deformed while the interference state with the first housing protrusions 113 and the second housing protrusions 114 is switched or changed. Having the protection part 12, and specifically the first protection arms 123 and second protection arms 124 being deformed while the interference state is switched, as distinct from the housing 11, allows the connector assembly to have improved durability.

As set forth above, the first housing 11 may accommodate the protection part 12 and includes a housing base 111, a housing body 112 protruding from the housing base 111, the first housing protrusions 113 protruding from the housing base 111 and provided in an inside of the housing body 112, and the second housing protrusions 114 protruding from the housing base 111 and provided in the inside of the housing body 112.

The housing base 111 may have a plate shape. The housing base 111 may include a plurality of housing holes 111*a* for supporting the plurality of terminals (not shown). The plurality of housing holes 111*a* may be formed through the base 111 in the z-axial direction. The plurality of housing holes 111*a* assist in the mounting of the plurality of terminals.

The housing body 112 may protrude from the housing base 111 in the z-axial direction. The housing body 112 may have a shape defining a hollow interior. The housing body 112 may enclose the plurality of terminals (not shown). The housing body 112 may include a first housing body side wall 112*a* having an inner side surface normal to the y-axial direction and a second housing body side wall 112*b* having an inner side surface normal to the x-axial direction. The first housing body side wall 112*a* and the second housing body side wall 112*b* may meet each other perpendicularly.

The first housing protrusions 113 may support the protection part 12 with no external force applied to the protection part 12, assisting the protection part 12 to be spaced apart from the housing base 111 in the z-axial direction. When an external force is applied to the protection part 12, the protection part 12 is deformed, engaging with the first housing protrusions 113, and the protection part 12 may disengage from the first housing protrusions 113. In this case, the protection part 12 may pass through the first housing protrusions 113. The operations of the first housing protrusions 113 and the first protection arms 123 will be described further with reference to FIGS. 6 to 9.

The first housing protrusions 113 may protrude from the housing base 111 in the z-axial direction. The first housing protrusions 113 may be provided in the inside of the housing body 112. For example, the first housing protrusions 113 may be provided in close contact with the inner side surface of the housing body 112. The first housing protrusions 113 may be formed as an integral body with the housing base 111 and the housing body 112. According to this embodiment, there is no space between the first housing protrusions 113 and the housing body 112. As a result, the first housing 11 may have a compact size. The first housing protrusions 113 may be provided symmetrically on opposite sides relative to the center of the first housing 11. For example, the first housing protrusions 113 may be provided respectively on the +y side and the −y side based on the center of the first housing 11.

The first housing protrusions 113*a* and 113*b* may be provided in a pair and may face each other. The pair of first housing protrusions 113*a* and 113*b* may respectively include first housing protrusion bodies 1131*a* and 1131*b* protruding from the housing base 111, and first housing protrusion heads 1132*a* and 1132*b* protruding from the first housing protrusion bodies 1131*a* and 1131*b*. For example, one first housing protrusion 113*a* of the first housing protrusions 113*a* and 113*b* may include the first housing protrusion body 1131*a* protruding from the housing base 111 in the z-axial direction, and the first housing protrusion head 1132*a* protruding from the first housing protrusion body 1131*a* in the x-axial direction. The other one first housing protrusion 113*b* of the first housing protrusions 113*a* and 113*b* may include the first housing protrusion body 1131*b* protruding from the housing base 111 in the z-axial direction, and the first housing protrusion head 1132*b* protruding from the first housing protrusion body 1131*b* in the x-axial direction. The first housing protrusion head 1132*a* and the first housing protrusion head 1132*b* may protrude toward each other.

The second housing protrusions 114 may assist the second protection arms 124 of the protection part 12 not to be deformed when the protection part 12 is in a lowering position. The second housing protrusions 114 may be defined at a lower height within, or at a bottom of, the housing body 112. While the protection part 12 is supported by the first housing protrusions 113, the second housing protrusions 114 may be spaced apart from the second protection arms 124. When the protection part 14 is no longer supported by the first housing protrusions 113 and lowered along the housing body 112, the second housing protrusions 114 may cover the second protection arms 124 such that the second protection arms 124 are not or cannot be deformed outwardly. The second protection arms 124 may be supported by the second housing protrusions 114 such that they cannot be deformed while the protection part 12 is raised from the housing base 111 by a predetermined distance. When the protection part 12 is raised in excess of the predetermined distance, the second protection arms 124 is no longer supported by the second housing protrusions 114 and may be deformed, whereby an insertion part (that is, the second connector 2) may be easily decoupled from the protection part 12.

The operations of the second housing protrusions 114 and the second protection arms 124 will be described further with reference to FIGS. 10 to 13. The second housing protrusions 114 may protrude from the housing base 111 in the z-axial direction. The second housing protrusions 114 may be provided in the inside of the housing body 112. For example, the second housing protrusions 114 may be provided in close contact with the inner side surface of the housing body 112. For example, the second housing protrusions 114 may be formed as an integral body with the housing base 111 and the housing body 112.

The protection part 12 may include a protection base 121 facing the housing base 111, a protection body 122 protruding from the protection base 121, the first protection arms 123 extending from the protection body 122 to engage with the first housing protrusions 113, and the second protection arms 124 extending from the protection body 122 to engage with the second housing protrusions 114.

The protection base 121 may have a plate shape. The protection base 121 may be provided to be substantially parallel to the housing base 111. The protection base 121 may include a plurality of protection holes 121*a* for supporting the plurality of terminals (not shown). The plurality of protection holes 121*a* may be formed through the base 121 in the z-axial direction. The plurality of protection holes 121*a* may position and support the plurality of terminals. One side of a terminal (not shown) may be supported by a housing hole 111*a* and the other side thereof may be supported by a protection hole 121*a*.

The protection body 122 may protrude from the protection base 121 in the z-axial direction. The protection body 122 may have a shape having a hollow inside or interior. The protection body 122 may enclose the plurality of terminals (not shown). The protection body 122 may include a first protection body side wall 122*a* having an inner side surface normal to the y-axial direction and a second protection body side wall 122*b* having an inner side surface normal to the x-axial direction. The first protection body side wall 122*a* and the second protection body side wall 122*b* may meet each other perpendicularly.

The first protection arms 123 may protrude from the protection body 122. The first protection arms 123 may protrude from an upper portion of the protection body 122 in the −z direction. The first protection arms 123 may move about a portion thereof connected to the protection body 122. The first protection arms 123 may be deformed by an external force. The first protection arms 123 may be provided in a state of engaging with the first housing protrusions 113. When an external force is applied to and deforms the first protection arms 123, the first protection arms 123 may disengage from the first housing protrusions 113.

The first protection arms 123 may protrude, for example, from the upper portion of the first protection body side wall 122*a* in the z-axial direction. The first protection arms 123 may move about the y-axis by an external force. In other words, lower end portions of the first protection arms 123 may move in the x-axial direction. The first protection arms 123 may be in a state of engaging with the first housing protrusions 113, and move in the x-axial direction to switch to a state of being spaced apart from the first housing protrusions 113.

The first protection arms 123*a* and 123*b* may be provided in a pair. The pair of first protection arms 123*a* and 123*b* may be deformed in opposite directions in response to interference with the insertion part (that is, the second connector 2). For example, while a lower end portion of one first protection arm 123*a* of the pair of first protection arms 123*a* and 123*b* is deformed in the +x direction, a lower end portion of the other one first protection arm 123*b* may be deformed in the −x direction. One first protection arm 123*a* of the pair of first protection arms 123*a* and 123*b* may engage with the first housing protrusion 113*a*, and the other one first protection arm 123*b* may engage with the first housing protrusion 113*b*.

The second protection arms 124 may protrude from the protection body 122. The second protection arms 124 may protrude from the upper portion of the protection body 122 in the −z direction. The second protection arms 124 may move about a portion thereof connected to the protection body 122. Each second protection arm 124 may include a pair of second protection arm bodies 1241 formed in the z-axial direction, and a second protection arm head 1242 connecting the pair of second protection arm bodies 1241. The second protection arm head 1242 may be provided in the y-axial direction.

Herein, the second connector 2 may also be referred to as the insertion part 2. The insertion part 2 may include an insertion body 21 to be inserted into the protection part 12, first insertion protrusions 22 protruding from the insertion body 21 to interfere with the first protection arms 123, second insertion protrusions 23 protruding from the insertion body 21 to interfere with the second protection arms 124, insertion ribs 24 protruding from an upper end edge of the insertion body 21 to press the upper end of the protection body 122, and insertion guides 25 formed in the upper portion of the insertion body 21 to slide while being in surface contact with the protection body 122. The insertion body 21 may include a first surface 21*a* normal to the y-axial direction and that faces the first protection arms 123, and a second surface 21*b* normal to the x-axial direction and that faces the second protection arms 124.

The first insertion protrusions 22 may deform the first protection arms 123 to disengage the first protection arms 123 from the first housing protrusions 113 while the insertion body 21 is inserted into the inside of the protection part 12. The first insertion protrusions 22 may protrude from the first surface 21*a*, and the first protection arms 123 may move in a direction intersecting with the normal direction of the first surface 21*a*. For example, the first protection arms 123 may move in the x-axial direction intersecting with the y-axial direction that is the normal direction of the first surface 21*a*. The first protection arms 123 may move about the y-axis. For example, the first protection arms 123 may move in a direction parallel to the first surface 21*a*. These movements obviate the need for separate space for the movement of the first protection arms 123, thus allowing the housing body 112 and the protection body 122 to be in close contact and the first connector 1 to have a compact structure.

The first insertion protrusions 22 may be provided in a pair, and the first protection arms 123 may be provided in a pair. The pair of first insertion protrusions 22 may be spaced apart from each other in the x-axial direction. The pair of first insertion protrusions 22 may deform the pair of first protection arms 123 toward each other. For example, the pair of first protection arms 123 may touch each other when they are in maximum approach or at a minimum required deflection. This structure may prevent excessive deformation of the first protection arms 123.

Figure 4:
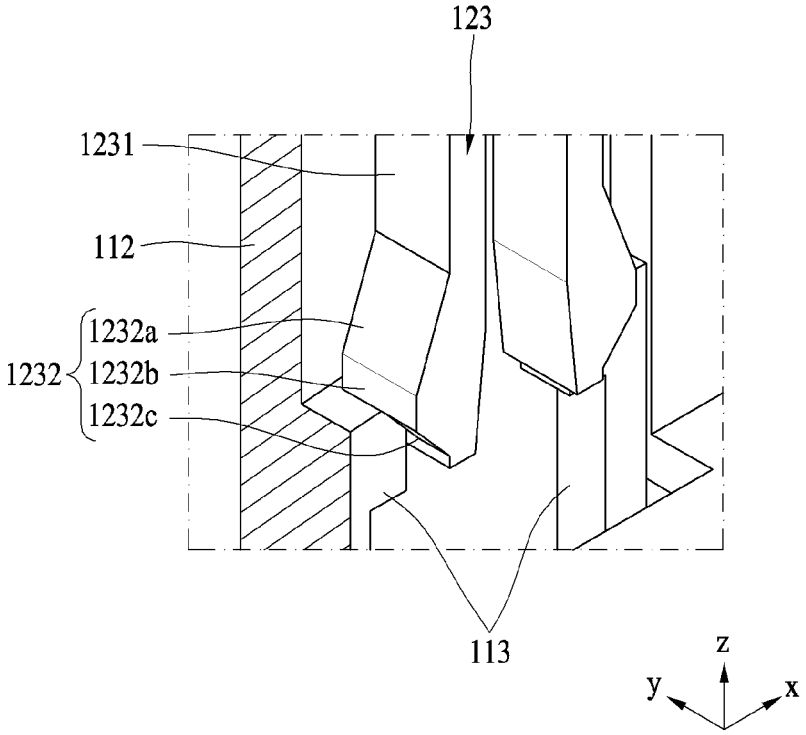
FIG. 4 is a partially enlarged view illustrating a connector assembly according to an example embodiment.
Figure 5:
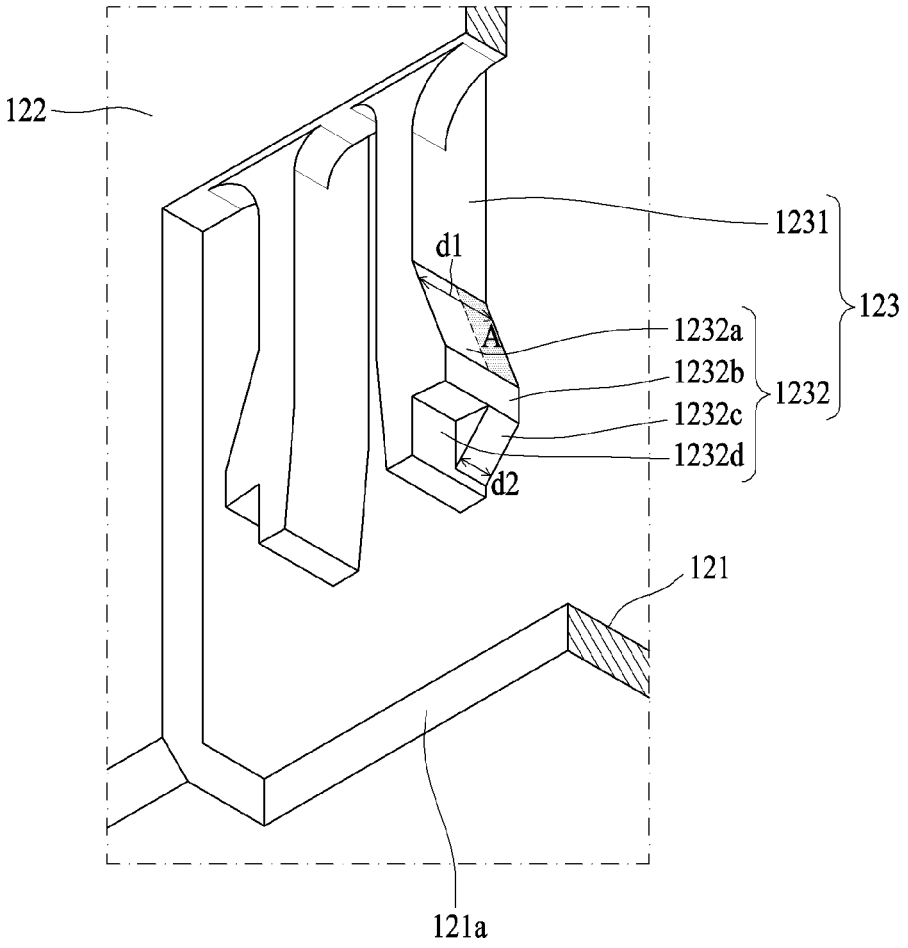
FIG. 5 is a perspective view illustrating first protection arms according to an example embodiment.
Figure 6:
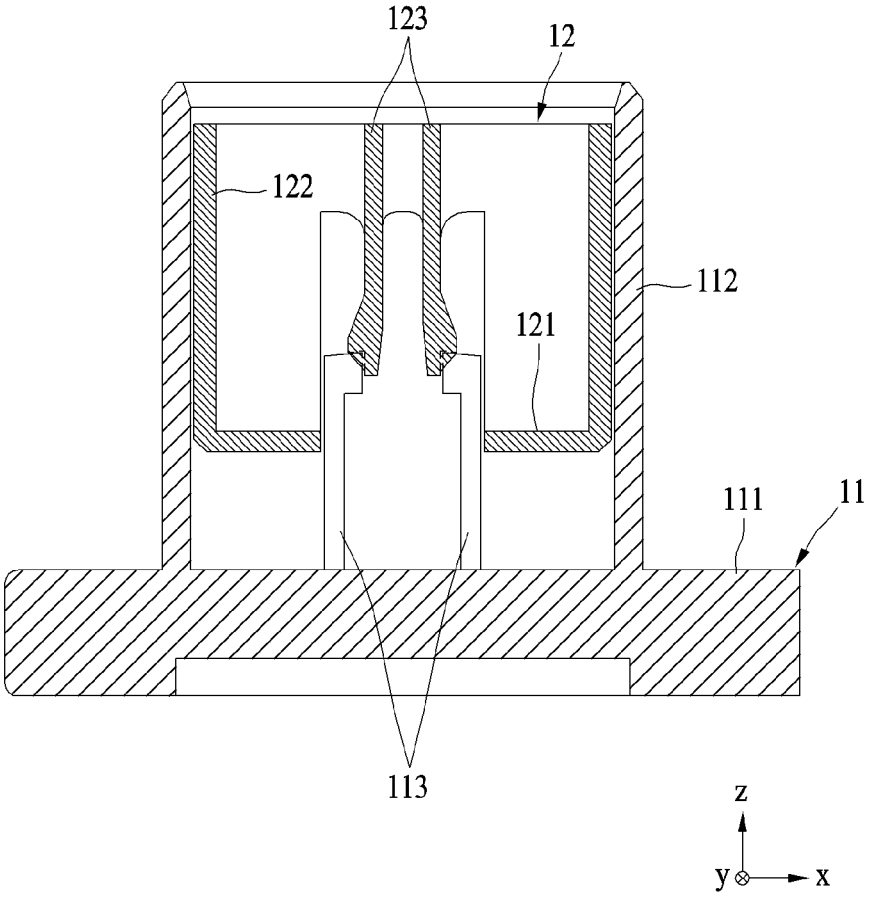
FIGS. 6 to 9 are cross-sectional views illustrating interactions between first housing protrusions and first protection arms of a connector assembly according to an exemplary embodiment.
Figure 7:
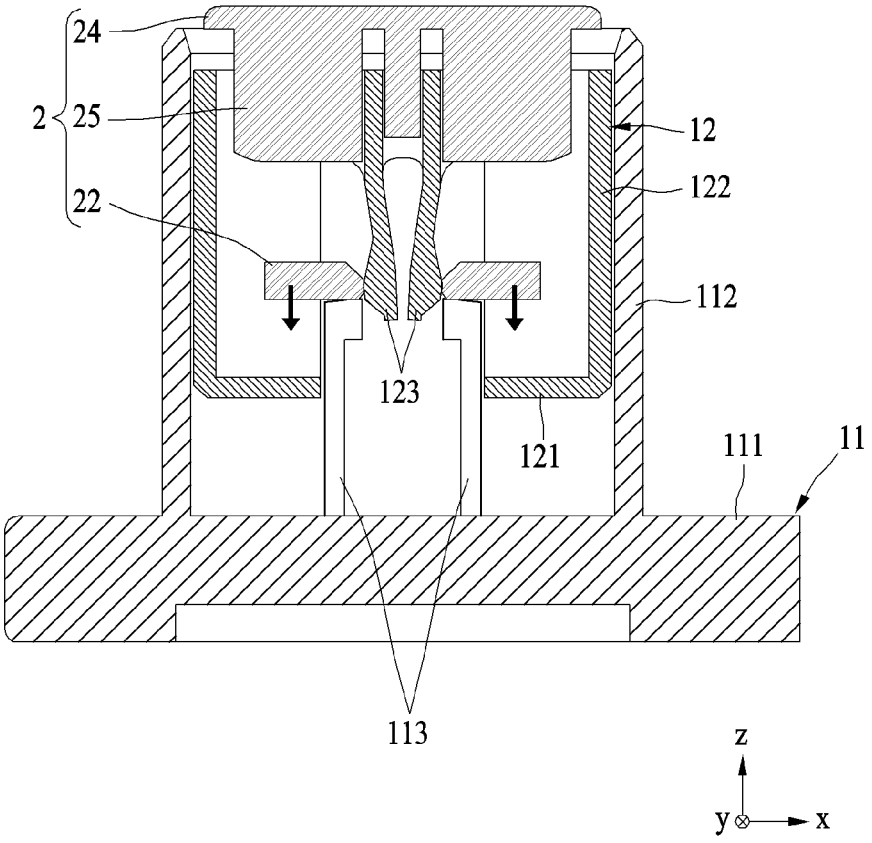
Figure 8:
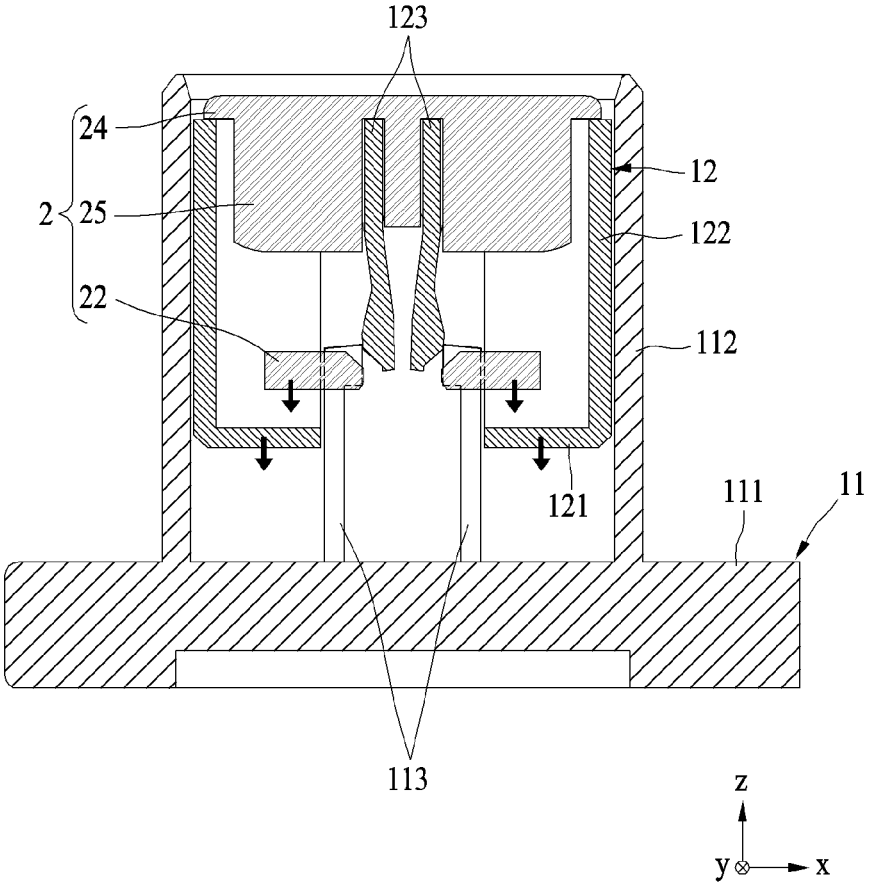
Figure 9:
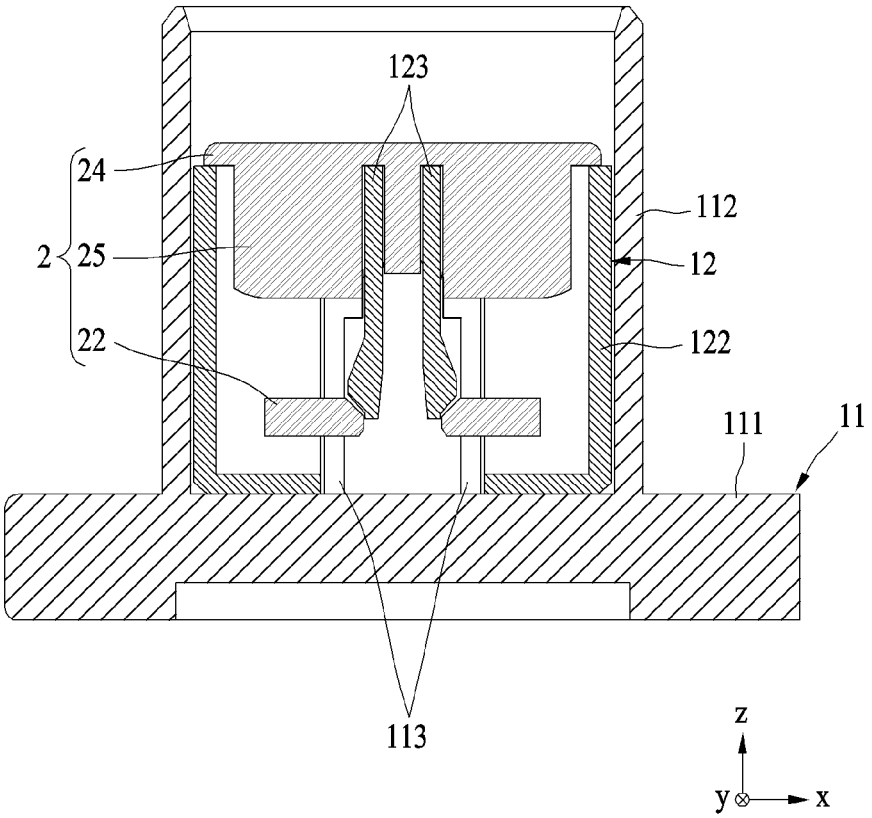
Figure 10:
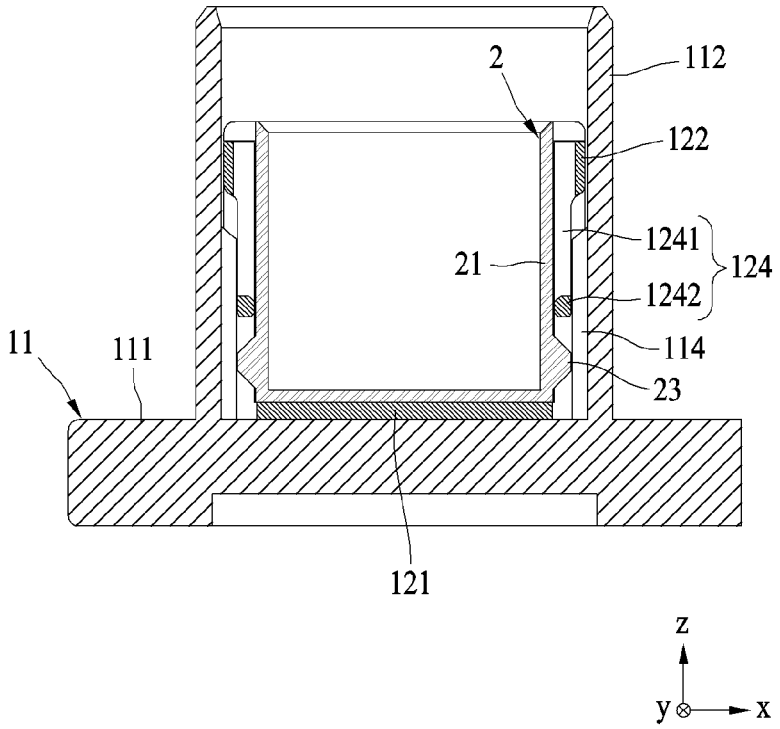
FIGS. 10 to 13 are cross-sectional views illustrating interactions between second housing protrusions and second protection arms of a connector assembly according to an exemplary embodiment.
Figure 11:
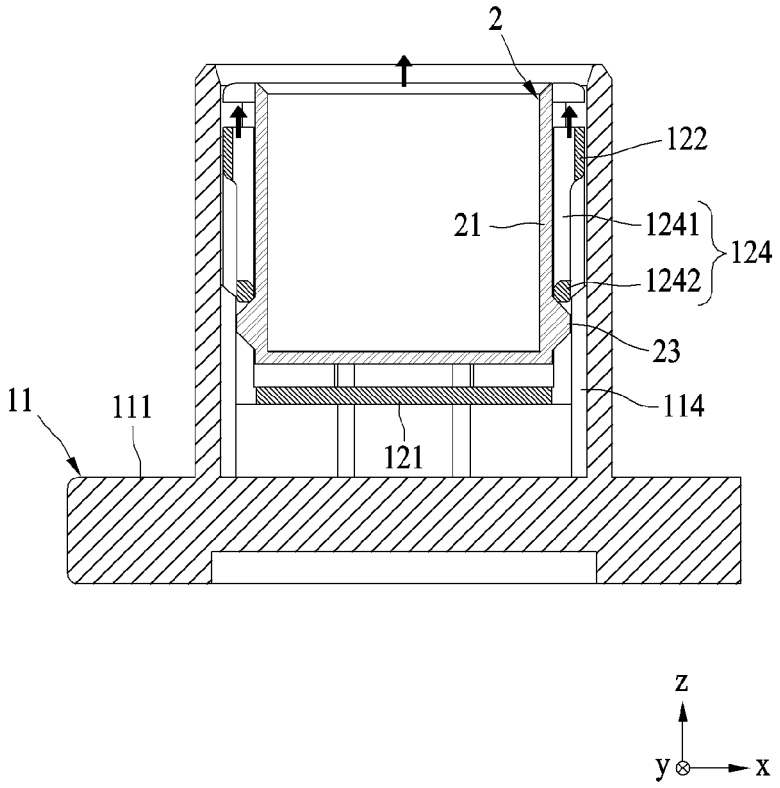
Figure 12:
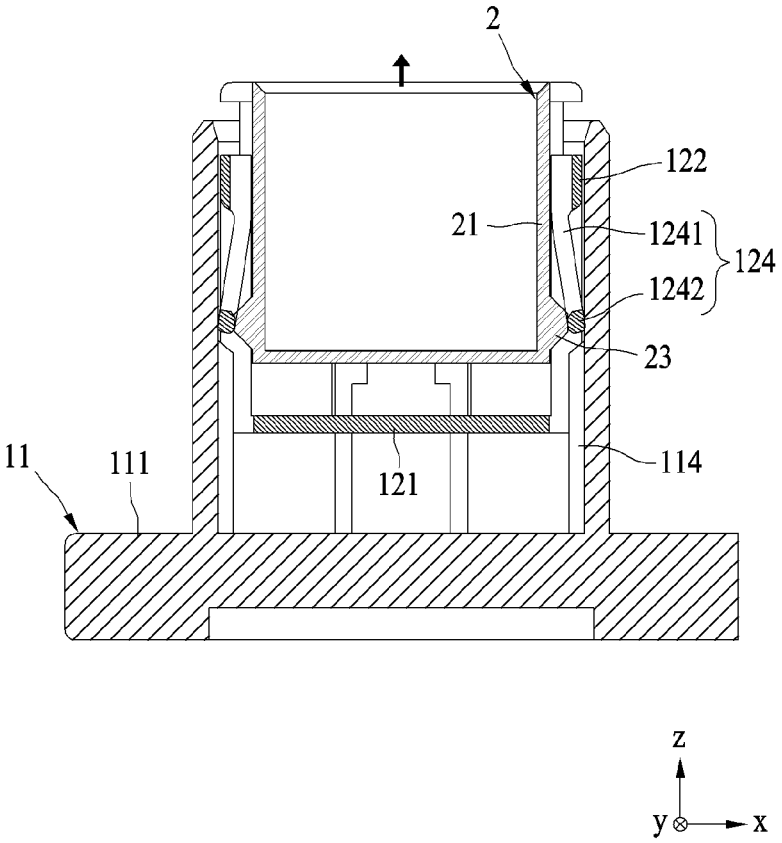
Figure 13:
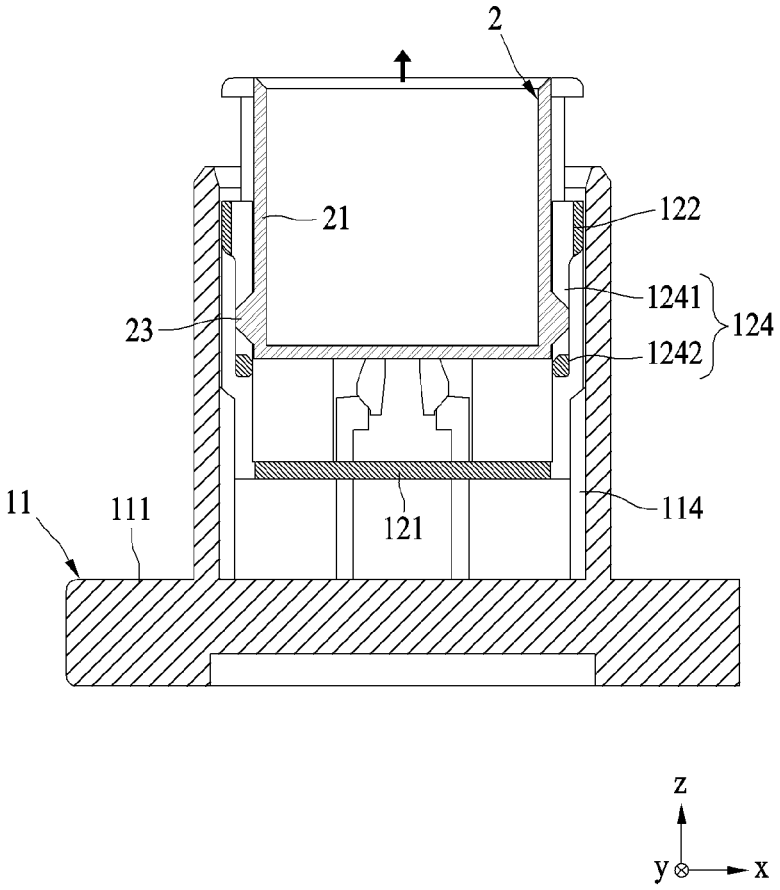

FIG. 4 is a partially enlarged view illustrating a connector assembly according to an example embodiment, and FIG. 5 is a perspective view illustrating first protection arms according to an example embodiment. FIGS. 3 and 4 show the first protection arms 123 viewed from the inside of the protection part 12, whereas FIG. 5 shows the first protection arms 123 viewed from the outside of the protection part 12. Referring to FIGS. 4 and 5, each first protection arm 123 may include a first protection arm body 1231 extending from the protection body 122 in a first direction, for example, the z-axial direction, and a first protection arm head 1232 protruding from the first protection arm body 1231 in a second direction intersecting with the first direction, for example, the x-axial direction.

The protection base 121 may include, based on the +z direction, a cut part 121*a* for exposing a first protection arm 123 to a first housing protrusion 113. The first protection arm 123 may be positioned more inside relative to the outermost edge portion of the protection body 122. The cut part 121*a* may prevent the protection base 121 from interfering with the first housing protrusion 113 while the protection body 122 is lowered or inserted. For example, the cut part 121*a* may be a portion recessed from the edge portion of the protection base 121. A width of the cut part 121*a* in the x-axial direction may be wider than an interval or distance between a pair of first housing protrusions 113. The cut part 121*a* may accommodate the pair of first housing protrusions 113. This shape allows the protection body 122 to be in close contact with the housing body 112 and allows the protection base 121 to accommodate the pair of first housing protrusions 113, thereby enabling the connector assembly to have a compact size. The width of the cut part 121*a* in the x-axial direction may be wider than an interval or spacing between a pair of first protection arms 123. The pair of first protection arms 123 may move within an area exposed by the cut part 121*a*.

The first protection arm body 1231 may move about the y-axis. The first protection arm body 1231 may move in the x-axial direction. The first protection arm body 1231 may move in a direction parallel to an outer surface of the insertion body 21 whose normal direction is the y-axial direction. The first protection arm body 1231 may move in a direction parallel to an inner surface of the housing body 112 whose normal direction is the y-axial direction.

The first protection arm head 1232 may be provided in a state of engaging with the first housing protrusion 113 while no external force is applied thereto. The first protection arm head 1232 may interfere with a first insertion protrusion (see FIG. 1). A portion of the first protection arm head 1232 supported by the first housing protrusion 113 may not overlap, in the z-axial direction, a portion of the first protection arm head 1232 interferes with the first insertion protrusion (see FIG. 1). This structure may allow the first insertion protrusion (see FIG. 1) not to engage with the first housing protrusion 113 while the insertion body 21 is lowered.

The first protection arm head 1232 may include a first inclined part 1232*a* whose height protruding from the first protection arm body 1231 increases along an insertion direction of the insertion body 21, for example, the z-axial direction, a head body part 1232*b* with a support surface 1232*d* to contact the first housing protrusion 113, and a second inclined part 1232*c* whose height protruding from the first protection arm body 1231 decreases along the insertion direction of the insertion body 21. The second inclined part 1232*c* may not overlap the first housing protrusion 113 based on the insertion direction of the insertion body 21, for example, the z-axial direction.

The first inclined part 1232*a* may have an interference surface A to contact a first insertion protrusion 22. The interference surface A may overlap the second inclined part 1232*c* in the z-axial direction. The first inclined part 1232*a* may have a first width d1 that is approximately equal to a width of the first protection arm body 1231. The second inclined part 1232*c* may have a second width d2 that is smaller than the width of the first inclined part 1232*a*. The second inclined part 1232*c* may interfere with a first insertion protrusion (see FIG. 1) while the first insertion protrusion (see FIG. 1) is raised.

FIGS. 6 to 9 are cross-sectional views illustrating interactions between first housing protrusions and first protection arms of a connector assembly according to an exemplary embodiment. Referring to FIGS. 6 to 9, the protection part 12 may be provided in the housing 11. The protection base 121 may face the housing base 111 but may be provided at a position spaced apart therefrom in the z-axial direction. The first protection arms 123 may be supported by or on the first housing protrusions 113. The protection body 122 may slide along the housing body 112.

While the insertion part 2 is inserted into the inside of the protection part 12, the first insertion protrusions 22 may allow the first protection arms 123 to disengage from the first housing protrusions 113. The first insertion protrusions 22 may allow the first protection arms 123 to be free from the support of the first housing protrusions 113. The insertion guides 25 may slide along the first protection arms 123. The insertion ribs 24 may press the upper edge portion of the protection body 122, thereby lowering the protection part 12.

After the first protection arms 123 are free from the support of the first housing protrusions 113, the insertion ribs 24 may lower the protection part 12 until the protection base 121 of the protection part 12 contacts the housing base 111.

FIGS. 10 to 13 are cross-sectional views illustrating interactions between second housing protrusions and second protection arms of a connector assembly according to an exemplary embodiment. Referring to FIGS. 10 to 13, the protection part 12 may be provided in the housing 11. The protection base 121 may face the housing base 111. When the insertion part 2 is fully inserted, the second insertion protrusions 23 may be located at a lower side than the second protection arms 124.

While the insertion part 2 is raised, that is, while the insertion part 2 is decoupled from the protection part 12, the second insertion protrusions 23 may press the second protection arm heads 1242 of the second protection arms 124 in the +z direction, thereby raising the protection part 12. While the second protection arm heads 1242 are at the position to overlap the second housing protrusions 114 in the x-axial direction, the x-axial movement of the second protection arm bodies 1241 may be restricted by the second housing protrusions 114. The protection body 122 may be raised in the +z direction along the housing body 112.

When the insertion part 2 is raised in excess of a predetermined distance, for example, when the second protection arm heads 1242 are raised in the x-axial direction to the position in which they do not overlap the second housing protrusions 114, the second protection arm bodies 1241 may receive outward force from the second insertion protrusions 23 and may be deformed outwardly. In this case, the second insertion protrusions 23 may pass through the second protection arm heads 1242, and as a result, the insertion part 2 may be decoupled from the protection part 12.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly, comprising: a housing including a housing base, and a first housing protrusion provided inside the housing; a protection part including a protection base facing the housing base, a protection body protruding from the protection base, and a first protection arm extending from the protection body for engaging with the first housing protrusion; and an insertion part inserted inside of the protection part and including a first insertion protrusion protruding therefrom for interfering with the first protection arm, the first insertion protrusion deforming the first protection arm and causing the first protection arm to disengage from the first housing protrusion while the insertion part is inserted inside of the protection part; wherein each of the first insertion protrusion and the first protection arm is provided in a pair, the pair of first insertion protrusions deforming the pair of first protection arms toward each other.

2. The connector assembly of claim 1, wherein the insertion part includes a first surface facing the first protection arms, the first insertion protrusions protrudes from the first surface, and the first protection arm is movable in a direction intersecting with a normal direction of the first surface.

3. The connector assembly of claim 2, wherein the first protection arm is movable in a direction parallel to the first surface.

4. The connector assembly of claim 1, wherein the protection base comprises a cut part recessed from an edge portion toward the center for receiving the pair of first housing protrusions.

5. The connector assembly of claim 1, wherein the first housing protrusion includes:

a first housing protrusion body protruding from the housing base in a first direction; and a first housing protrusion head protruding from an end portion of the first housing protrusion body in a second direction intersecting with the first direction to interfere with the first protection arm.

6. The connector assembly of claim 1, wherein the first protection arm includes:

a first protection arm body extending from the protection body in a first direction; and a first protection arm head protruding from the first protection arm body in a second direction intersecting with the first direction to interfere with the first housing protrusion.

7. The connector assembly of claim 6, wherein a portion of the first protection arm head supported by the first housing protrusion does not overlap a portion of the first protection arm head interfering with the first insertion protrusion.

8. The connector assembly of claim 6, wherein the first protection arm head includes a first inclined part having a height protruding from the first protection arm body increasing along an insertion direction of the insertion part.

9. The connector assembly of claim 8, wherein the first protection arm head further includes a second inclined part having a height protruding from the first protection arm body decreasing along the insertion direction and that does not overlap the first housing protrusion in the insertion direction.

10. The connector assembly of claim 9, wherein a width of the second inclined part is less than a width of the first inclined part.

11. The connector assembly of claim 1, wherein the protection part further includes a second protection arm extending from the protection body and spaced apart from the first protection arm.

12. The connector assembly of claim 11, wherein the insertion part further includes a second insertion protrusion interfering with the second protection arm protruding from the insertion part.

13. The connector assembly of claim 12, wherein the housing further includes a second housing protrusion protruding from the housing base, the second protection arm is prevented from being deformed by the second housing protrusion while the protection part is raised a predetermined distance from the housing base.

14. A connector assembly, comprising: a housing including a housing base, a first housing protrusion provided inside of the housing, and a second housing protrusion protruding from the housing base and having a height lower than a height of the housing body; a protection part including a protection base facing the housing base, a protection body protruding from the protection base, a first protection arm extending from the protection body for engaging with the first housing protrusion, and a second protection arm extending from the protection body and positioned spaced apart from the first protection arm; and an insertion part inserted into the protection part and including a first insertion protrusion protruding therefrom for interfering with the first protection arm, and a second insertion protrusion protruding from the insertion part for interfering with the second protection arm; wherein each of the first insertion protrusion and the first protection arm is provided in a pair, the pair of first insertion protrusions deforming the pair of first protection arms toward each other.

15. The connector assembly of claim 14, wherein the first insertion protrusion deforms the first protection arm for disengaging the first protection arm from the first housing protrusion while the insertion part is inserted into the protection part.

16. The connector assembly of claim 14, wherein the insertion part includes a first surface facing the first protection arm and a second surface facing the second protection arm, the first insertion protrusion protruding from the first surface.

17. The connector assembly of claim 16, wherein the first protection arm is movable in a direction parallel to the first surface, and the second protection arm is movable in a direction normal to the second surface.

18. The connector assembly of claim 14, wherein the first housing protrusion includes:

a first housing protrusion body protruding from the housing base in a first direction; and a first housing protrusion head protruding from an end portion of the first housing protrusion body in a second direction normal to the first direction for interfering with the first protection arm.

19. The connector assembly of claim 14, wherein the first protection arm includes:

a first protection arm body extending from the protection body in a first direction; and a first protection arm head protruding from the first protection arm body for interfering with the first housing protrusion.

* * * * *